United States Patent [19]

Wirth

[11] Patent Number: 4,599,766

[45] Date of Patent: Jul. 15, 1986

[54] METHOD AND APPARATUS FOR FORMING A MORE EVEN WEB FROM STAPLE FIBERS

[75] Inventor: Walter Wirth, Duelmen, Fed. Rep. of Germany

[73] Assignee: Hergeth Hollingsworth GmbH, Duelmen, Fed. Rep. of Germany

[21] Appl. No.: 684,877

[22] Filed: Dec. 21, 1984

[30] Foreign Application Priority Data

Dec. 22, 1983 [DE] Fed. Rep. of Germany ..... 3346335

[51] Int. Cl.[4] ..... D01G 15/46

[52] U.S. Cl. ..... 19/106 R; 19/296

[58] Field of Search ..... 19/106 R, 98, 99, 100, 19/101, 108, 296

[56] References Cited

U.S. PATENT DOCUMENTS 3,256,569 6/1966 Draving ..... 19/106 R 4,279,060 7/1981 Wirth ..... 19/106 R

*Primary Examiner*—Louis K. Rimrodt

*Assistant Examiner*—J. L. Olds

[57] ABSTRACT

In conjunction with a randomizing web former is disclosed means for regulating the pressures subsisting within the jamming slot of the randomizing web former formed between the arcuate toothed surface of a carded staple fiber bearing cylinder and a confining surface mounted adjacent thereto. The regulating means includes a housing one wall of which is perforate so as to provide gaseous intercommunication with the interior plenum thereof, in which resides a pressure sensing element interconnected with a control element such as a preprogrammed computer. The plenum intercommunicates with a pressure adjusting device, and the latter is operatively interconnected with the control element. Signal from the sensor reflecting the then pressure within the jamming slot when received by the control element is compared with a target or desired pressure; any difference calculated is transmitted in the form of a command signal to the pressure adjusting device which forces more air into the plenum and thus into the jamming slot in instances of sensed pressures below the target pressure, or removes air as by a vacuum from the plenum and thus reduces pressure in the jamming slot when the sensed pressure there is greater than the targetted pressure desired.

20 Claims, 2 Drawing Figures

METHOD AND APPARATUS FOR FORMING A MORE EVEN WEB FROM STAPLE FIBERS

BACKGROUND OF THE INVENTION

This invention relates to method and means for forming a more even web of staple fibers of randomized orientation suitable for nonwoven end uses. The present invention employs centrifugal, dynamic web forming. A method and means therefor known in the art are as disclosed in U.S. Pat. No. 4,279,060 of July 21, 1981. Generally, there one uses a carding action to disentangle the staple fibers of fibrous flocks and form a web of a layer of such fibers oriented such that their axes extend more parallel one another than theretofore and in the direction of fiber flowpath in the process machinery. The resultant web removed from the carding device is subjected to an accumulator, or bunching or jamming or damming action to increase its depth to provide a more dense web of greater than one-fiber thickness, and thereafter is subjected to centrifugal aerodynamic forces, so called free web formation, and then doffed from the apparatus. The doffed web then is suitable for producing or for use as nonwoven fabrics. Depending upon the degree of bunching and after-treatment of the webs produced, they are suitable for providing so-called light weight (from 8 to 25 grams of web per square meter of surface area), medium weight (from 25 to 75 grams per square meter) or heavy weight (from 70 to 250 grams per square meter) nonwoven fabrics.

The means of U.S. Pat. No. 4,279,060 is particularly instructive in understanding the foregoing general method. There one employs the well known carding cylinder and doffer; however, interposed therebetween is the cenrifugal, aerodynamic web former. It comprises an intermediate toothed cylinder and a special guide surface adjacent thereto. The cylinder is fitted with a toothed surface wherein the protruding teeth have a front rake thereof set at an angle of from zero to just a few angular degrees, whereby the extention of the front rake of the toothing theoretically passes through the center point of the circular path formed by the roller or cylinder surface bearing the toothing. Coacting with the toothing is a guide plate set along a portion of the circumference of the cylinder but is spaced somewhat away therefrom along the flowpath of material carried by the toothing such that the spacing progressively diminishes downstream so that, in example, at the entry to the space between the teeth and the guide plate's adjacent surface the spacing may be 3 to 6 millimeters and then diminish to a spacing of only one millimeter at the region of the exiting of the material from the space. This produces what is now known as the accumulating, bunching, jamming or damming action. Then when the bunched fibrous layer or web leaves the confined space above defined and the teeth of the intermediate roller cylinder, by what is believed to be inertia and centrifugal forces, it is flung a short distance, there said to be in example 8 to 12 millimeters, through what is called a free zone passing therethrough in aerodynamic flight until it encounters the teeth of the doffer roll. Evidentally, during such aerodynamic flight, the web is freed from the jamming effect and evens out to form the random non-woven web of staple fibers useful for forming or as a non-woven fabric.

The problem addressed by the aforesaid U.S. Pat. No. 4,279,060 is one of achieving a randomization of carded fibrous web in a relatively simple manner using, for the most part, carding and doffing elements well known in the art and easily available, without the need for expensive auxiliary machines, such as crosslappers. In this, attempts to attain greater and yet greater isotropy respecting the axes of fibers in the family of planes of the web, such as a greater equivalence of tear strengths and processabilities or the like in the directions transverse to the web length as in the direction of the web length, were sought.

While the approach employed in U.S. Pat. No. 4,279,060 was largely successful to provide an economical way to obtain randomization of the fibers axes, another factor arose which demanded consideration. It appeared that air flows and the agitative regime thereof, in the spacial regions where the parallelized staple fibers move into the web former slot between the teeth of the toothed or carding cylinder and the guide surface which defines a progressively diminishing depth thereof, have a profound affect upon the uniformity of the web produced in depth as well as randomness of orientation of the axes of the constituent fibers.

Depending upon the stock being processed, the degree of carding prior to its being subjected to randomizing, aerodynamic web forming, the surface speeds of the toothed cylinder and the doffer cylinder from which the fibers being randomized are flung into aerodynamic free flight and onto which they are caught, the respective surfaces of the moving toothed cylinder and the fixed slot forming plate or other member which define the jamming slot of the web former, as well as the direction, volume and speed of flow of the sundry air currents being generated thereat, one notes that there is complexity regarding prescribing randomness of orientation of the directions of the axes of the constituent fibers of the web produced and also, as mentioned, regarding the uniformity of web transversely as well as from length portion to length portion therealong being produced.

While many of these factors may be prescribably varied to desired values so that desired results may be obtained, at least one factor has heretofore eluded the art's attempts in this regard, that of prescribing and controlling the air flows generated and the resultant agitative regime produced thereby in the region of the web forming slot. It is to this vexsome problem that the present invention is addressed. In this one notes that the toothed slot-defining cylinder is operated at unusually high surface speeds in necessity of providing the high production rates demanded by commercial economics; further, that in so doing high concentrations of dust and micro-dust are liberated and which must through some means be contained for removal, as health standards and laws require, yet further compounding the problem here addressed.

OBJECTS OF THE INVENTION

Thus, it is an object of the invention to provide method and means for controlling the air flows and agitative regime to which fibers are subjected in the region of the randomizing web former and its jamming slot.

Another object is to provide such method and means which provides for removal of the dust and micro-dust as may be generated in this web forming region.

These and yet other desirable objects of the invention are attained through the method and means more fully explained below and defined in the claims.

SUMMARY OF THE INVENTION

According to the invention, the rapidly moving surface of the toothed cylinder bearing carded fibers into the jamming slot of the aerodynamic randomizing web former produces air currents proximal thereto and, within the jamming slot a buildup of pressure yielding what shall be termed an air jam, of excessive pressure within the slot and or regions of lower than atmospheric pressure at some portions of the region of the web former. The excessive pressure at certain portions increases the faster the toothed cylinder rotates and the toothed surface moves through the jamming slot. The doffer cylinder, or other receiving element such as a sieve band or sieve drum rather than a toothed doffer, as it moves also builds up a jacket of moving air thereabout which produces regions of excessive pressure and or less than atmospheric pressure (low presssure, or suction), but to a somewhat lower degree than the toothed cylinder bearing carded fibers. These effects result not only in the laminar flows of various air currents, but also in regions of air swirls and other turbulence creating the aforesaid regions of both higher and lower than atmospheric pressure in the critical triangular region of aerodynamic, randomizing web formation. In all, there is a disrupting effect on the orientation, distribution and movement of the carded fibers as they reside on the moving toothed cylinder surface as it is moved into, and through the hereinbefore defined slot, and as they are propelled by centrifugal forces from the cylinder's surface and into free flight for a prescribed distance until they encounter the collecting surface of the doffer or other receiving element and are layed thus thereupon as a randomized web. According to the invention, control is now provided by the method and means thereof to regulate the air pressures prevailing in the critical triangular region of randomized web formation. The invention contemplates a continuous sensing of air pressures at a pluality of loci in the triangular region, and the introduction or removal of air to compensate for a sensing respectively of insufficient or excessive pressure from a predetermined value. The means of the invention includes use of a wedge-shaped housing extending the width distance of the rotational axial length of the toothed cylinder bearing the carded staple fibers. Along this distance, the housing forms a chamber or a plurality of chambers for sensing air pressure, for receiving added air in instances of a sensed pressure lower than what is desired and conveying air away in instances of a sensed pressure in excess of what is desired. The wedge-shaped exterior contours of the housing along surfaces opposing the surfaces of the toothed cylinder and doffer respectively are fitted adjacent to these curved surfaces in complementary arcuity thereto, such that the surface opposing the toothed cylinder bearing the carded staple fibers forms with the complementary opposing surface of the housing the jamming slot wherein the spacing at the entry is greater than that at the exit and that there is a progressive diminishing of spacing therebetween.

The complementary opposing wedge surfaces of the housing to the surfaces respectively of the toothed fiber bearing cylinder and the doffer cylinder are perforate over a major portion thereof to provide passage therethrough of air for relieving excess pressure or for introducing air for relieving an excessive underpressure from what is desired. The housing is enclosed so that it may act as a chamber or be subdivided into a plurality of chambers and also to act as needed as a plenum type conduit. The perforations are of such a size as to enable the easy passage of air and dust or micro-dust therethrough for removal, but to prevent passage of staple fiber therethrough. Each chamber is fitted with one or more sensors interconnected operatively with a pressure measuring and or controlling device and a means for raising or lowering pressure within the chamber and also in the environs adjacent to the chamber in the region between the perforate walls of the housing and the toothed cylinder and the doffing cylinder.

Therefore, through such means and method one may control the air flows to a prescribed degree needed to assure that the web product formed is of good uniformity both transversely thereacross and from length to succeeding length.

DESCRIPTION OF THE DRAWINGS

This invention is better understood through the descriptions which follow when taken in conjunction with the appended drawings in which.

PREFERRED EMBODIMENT

Figure 1:
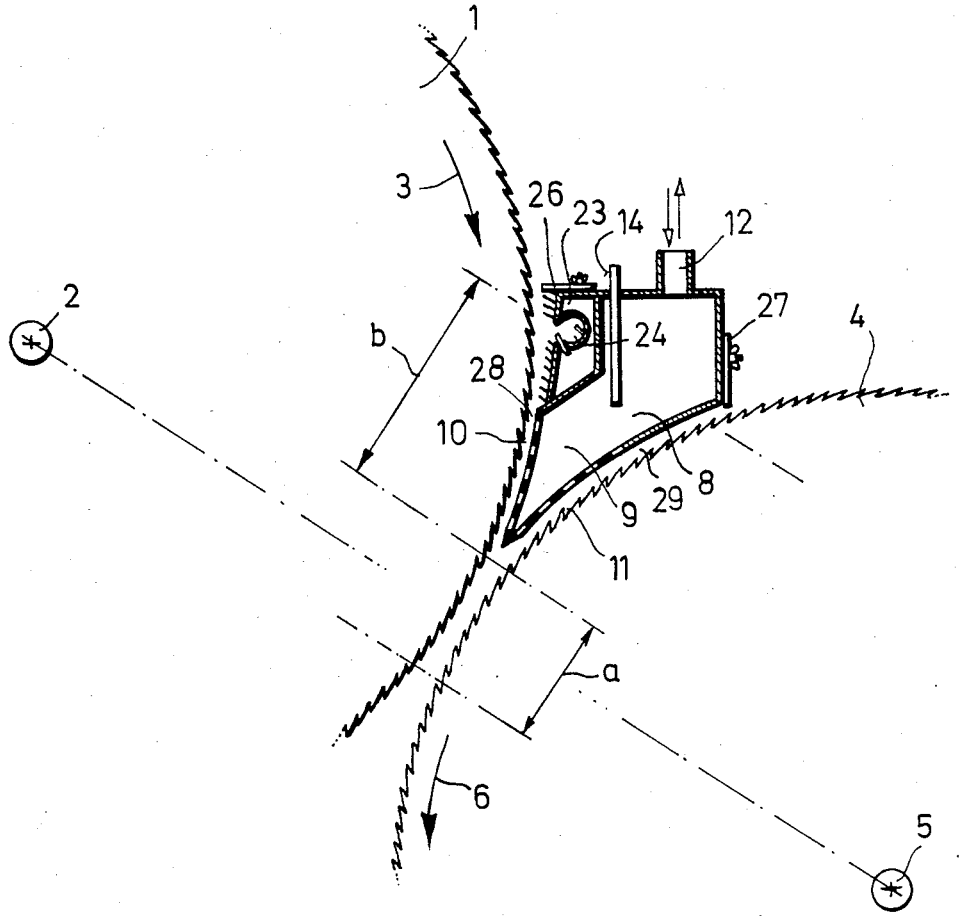
FIG. 1 shows, in side elevation, a fragmentary view of the present means of the invention showing the web-forming wedge-shaped housing in section.

With reference to FIG. 1, a toothed cylinder 1 for bearing carded staple fibers is shown to rotate about a shaft 2 therefor, in a direction designated by an arrow 3, and fixed to some frame (not shown) for cooperation with a doffer cylinder 4 similarly mounted in adjacency to cylinder 1 for rotation about its shaft 5 in the rotational sense designated by an arrow 6 to effect transfer of staple fibers from cylinder 1 to doffer 4. Cylinder 1 may be a carding cylinder of a carding machine or a carder or a toothed cylinder bearing card clothing or the like. The region of staple fiber transfer is that of closest approach of the two cylinders 1 and 4 designated by a double headed arrow marked a; this is called zone a bounded by the adjacent and opposing toothed surfaces of cylinder 1 and doffer 4. Upstream from zone a is another zone designated also by another double headed arrow marked b, and now called zone b. Zone b is somewhat wedgeshaped, bounded by the converging surfaces of cylinder 1 and doffer 4, respectively toothed surfaces 10 and 11. This triangularly shaped region of zone b can also be called the triangle of fleece or web formation, for according to this invention it is here where the present housing marked 8 is positioned, which housing 8 bears the surfaces which oppose toothed surface 10 of cylinder 1 and form with surface 10 the elongate jamming slot designated 28 useful in the bunching, and jamming and damming required in forming the randomized web having isotropic properties.

Figure 2:
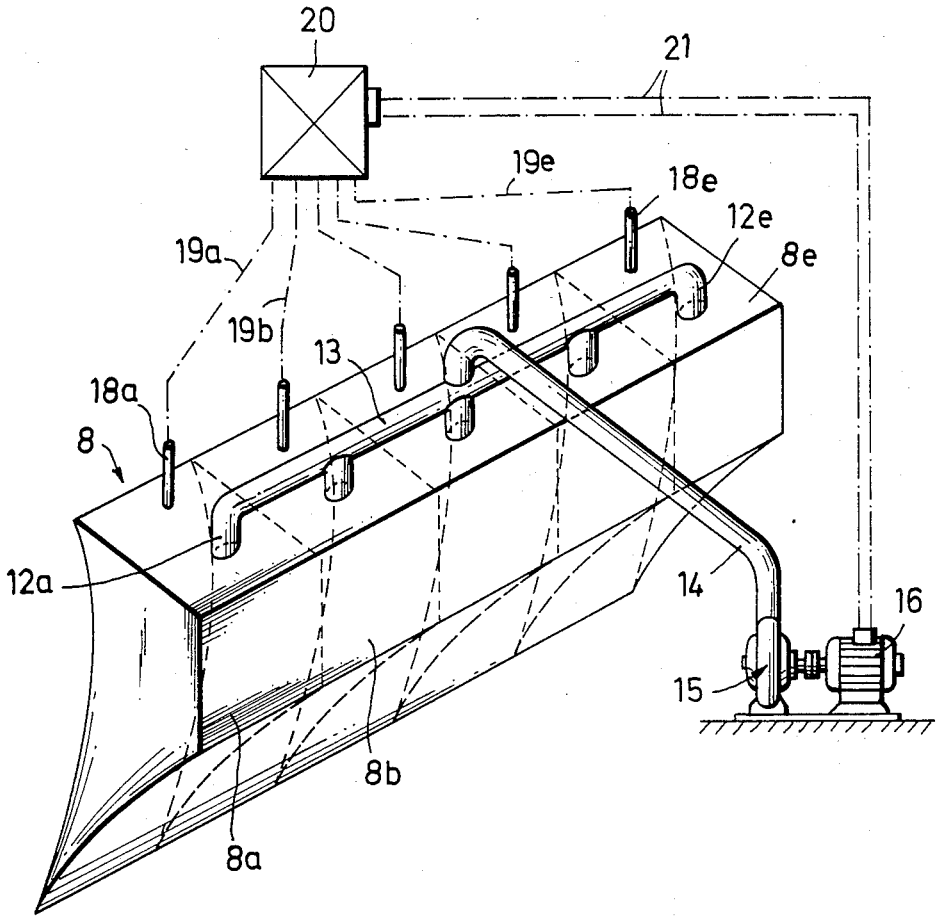
FIG. 2 is a perspective diagrammatic view of the instant wedge-shaped housing of the invention together with diagrammatic interconnections with the pressure sensing, and controlling means therefor.

Turning now also to FIG. 2, one may note that the plenum of enclosed housing 8 may be subdivided into a plurality of chambers designated 8*a*, 8*b* and so forth through chamber 8*e* across the width or depth of the housing 8 which is coextensive with the length of cylinder 1 and doffer 5. In providing such subdivisions, one then is better able, first, to more particularly sense the prevailing pressures of the air currents extant in the channels adjacent to each of the respective chambers, which is to say the channel forming the jamming slot formed between the surface 10 of cylinder 1 and the adjacent surface of housing 8 which opposes surface 10, and the channel formed on the other side of the wedge of housing 8 between the toothed surface 11 of doffer cylinder 4 and the adjacent surface of housing 8 which opposes it. Also, secondly, by such chambers one is better able to control such prevailing pressures to add or subtract as needs be to bring the respective pressures to a more equal state along the full extent of zone b and also zone a. In order to provide access to such channels for accurate sensing of prevaling pressures and their adjustment and equalization, housing 8 is formed with perforations in the walls forming the opposing surfaces to that of surface 10 of cylinder 1 and that of surface 11 of doffer 4. The perforations thus provide gaseous intercommunication between the plenum subdivision chambers 8*a* through 8*e* with those portions of the aforesaid channels adjacent thereto. The walls of housing 8 formed with said perforations may be in the form of a sieve or a grating or have but a few perforations or holes therethrough set at desired locations therethrough to achieve what here is described. When viewing such a chamber 8*a* let us say, looking at FIG. 1, one notes that there is provided in addition to the perforations an outlet-inlet means 12 for the introduction of air under a higher pressure and for the withdrawal of air, as by a vacuum source, and also a pressure sensor designated 18 (in FIG. 1 this is misdesignated as 14) in FIG. 1 and,as in a plurality, each corresponding to a plenum 8 subdivision designated 18*a* through 18*e* (FIG. 2). In turn, means 12 is connected by ducting 13 and 14 to intercommunicate with a means for adjusting air pressure 15 which conveniently may be a ventilator or source of high pressure to introduce a higher pressure upon demand and an evacuator or source of vacuum for lowering air pressure upon demand. It may contain whatever is needed, valving and so forth to quickly change from the imposition of a higher or a lower pressure upon demand and, as needed, to achieve what is required here to attain a desired equalized pressure along the whole extent of the channels hereinberfore defined.

Operation of the means 15 for adjusting air pressures within plenum chambers 8*a*, 8*b* through 8*e* is by a control means which includes sensor elements 18*a* through 18*e*, and further includes a controller element 20 to which elements 18*a* through 18*e* are operatively connected by means of electrical lines, shown as dashed-dotted lines 19*a* through 19*e*, an electric motor 16, which may be of the reversible kind so that it may cause means 15 when motor drives in one sense to reduce pressure and when motor 16 drives in the other sense to increase pressure within plenum 8 and adjacent portions of the hereinbefore defined channels, with electrical lines 21, shown also as dash-dot lines, operatively interconnecting motor 16 with controller element 20. Controller element 20 may be of any of the known types of controllers which upon receipt of a signal at variance with a predetermined or programmed target signal or value will provide output of such degree and time interval as is needed to effect changes in the sensed signal until it conforms to target signal, on a continual and continuous basis. By means of such pressure regulation, one may note that a change or a plurality of changes in the pressure or pressures extant across the entire extent of the aforesaid channels may be made to provide by the present means of this invention a uniform pressure thereacross to any prescribed and desired value. This provides an environment for forming a most even randomized web and nonwoven fabric across its transverse width and from length to length therealong.

From the foregoing, one may readily understand that, as may be needed, each plenum subdivision 8*a* and so forth may have its own separate means 15 for adjustment of air pressures immediately adjacent thereto in the respective jamming slot channel and that between doffer surface 11 and its opposing portion of the surface of subdivision 8*a*. For this, sensor 18*a* may feed its signals to either a separate controller element 20 and separate means 15 for adjusting air pressures only respecting the adjacent regions of chamber 8*a*, with like replication of elements for similar adjustments of pressures in further chambers 8*b* and so forth. Choice of the number of chambers 8*a* to 8*e* and of other elements set forth would be dictated by the criteria of obtaining sufficient equalization of pressures throughout the extent and range of zone b to produce a randomized web of desired uniformity of properties of randomization of tear strength, for example, and density both transversely and lengthwise of the web, all commensurate with the costs which can be endured.

Regarding the controller element 20 and the control means more generally, one may as shown employ a single element 20 for a plurality of sensors 18. In this instance, controller element 20 may be of the type which integrates the received signals for comparison with the target value to dictate what adjustment at that moment is needed in the plurality of chambers; alternately, as stated, one may feed the individual sensor-detected pressure values into a like plurality of controller elements 20 to effect changes in individual chambers; or indeed should the controller element be of sufficient capacity, controller element 20 may keep such signals separate and for each determine the change needed and feed individual command signals to a plurality of adjustment means 15 to make individual changes in each chamber, in all to produce the here desired results. In these, air pressure changes can be adjusted by a preprogramming to the target optimum value using the automatic pressure regulation provided by the present invention, in zone b for example, to that of approximately 100 N/cm or less. Such is generally sufficient to remove excess air and thus reduce excess pressure to the target value in the aforesaid channels to clear the web formation zone a of turbulent air. By present means of this invention, one thus now may accomodate all speeds of the various elements in the web formation process to maintain optimal conditions and produce great evenness in the product obtained.

Present housing 8, turning to FIG. 1, can be fitted with a carding segment 23 adjacent to and entending from the entry of the jamming slot channel 28 to that portion of the wall surface of housing 8 which is perforated. It has been found that in this way one may optimize the web formation process by advancing the fibers in a carded condition on cylinder 1 at toothed surface 10 to the point of transfer thereof to doffer 4 onto surface 11 in a most controlled manner. Segment 23 also serves as a fiber bagasse master, having its own dust suction removal channel 24 which may be interconnected with a suction source and a waste collection chamber (not shown).

One may provide for a further fine adjustment of air flows and pressures through use of an adjustable plate member 26 at the mouth of channel 28 and another such member 27 at the mouth of channel 29. They may be moved to restrict the respective mouth openings by wing-nut and slide adjustments. These may be used to help obtain optimal conditions to produce even web product.

Of course, with the foregoing disclosure in hand, one of ordinary skill in the art may immediately think of variations from what has been particularly described and shown which however are in accordance with the principles of the invention here taught and defined below in the claims. One such variation may be, for example, the use of a computer as controller element 20. Another may be the use of an housing 8 which has but the wall facing and opposing the toothed surface bearing the carded fibers with perforations, whereas the other wall at the wedge portion 9 which opposes and faces surface 11 of doffer 4 may in certain circumstances more profitably be imperforate.

I claim:

1. In a method for forming a random fibrous web from staple fibers, including disentangling the constitutent fibers of fibrous flock and forming a web thereof wherein said fibers are aligned substantially axially parallel one another through a carding action, and then randomizing the axial orientation of the fibers to provide a more isotropic web structure by means of centrifugal, aerodynamic web formation wherein carded fibers are moved through a zone in the form of a progressively narrowing slot about the arcuate surface of a toothed cylinder and then are propelled into free flight therefrom and onto the surface of a receiving means in a pattern of axial randomized orientation of the contituent fibers, the improvement comprising a. sensing the gas pressures extant at said zone, b. comparing said pressures with a predetermined pressure value, and c. adjusting said pressures in such a manner that they are changed to approach said predetermined pressure value at said zone.

2. The improvement as in claim 1, wherein said sensing is conducted at a plurality of loci adjacent to said zone.

3. The improvement as in claim 1, wherein said comparing and said adjusting are conducted in a continual and continuous manner.

4. The improvement as in claim 1, wherein said adjusting includes changing the degree of opening to said zone.

5. The improvement as in claim 1, including carding at said zone prior to said sensing.

6. In an apparatus for forming a random fibrous web from staple fibers, including means for forming a web from fibrous flock wherein said fibers are aligned substantially axially parallel one another through a carding action, and means for randomizing the axial orientation of said fibers to provide a more isotropic web structure by means of centrifugal , aerodynamic web formation wherein carded fibers are moved through a zone in the form of a progressively narrowing slot about the surface of a toothed cylinder and then are propelled into free flight therefrom and onto the surface of a receiving means in a pattern of axial randomized orientation of the constituent fibers, the improvement comprising a. sensing means for sensing gas pressures extant at said zone, b. means for comparing said pressures with a predetermined pressure value, and c. means for adjusting said pressures in such a manner that they are changed to approach said predetermined pressure at said zone.

7. The improvement as in claim 6, wherein said sensing means includes a pressure sensing element positioned at a location outside of said zone and in communication with said zone.

8. The improvement as in claim 7, wherein said pressure sensing element is separated from said zone by a wall which is formed with perforations therethrough.

9. The improvement as in claim 8, wherein said wall formed with perforations therethrough includes a portion thereof having said perforations proximal the portion of the slot which approaches where the fibers are flung into free flight.

10. The improvement as in claim 9, wherein said wall formed with perforations therethrough includes as a portion thereof a carding segment upstream from said portion having said perforations.

11. The improvement as in claim 10, wherein said carding segment includes a dust suction removal channel formed therein.

12. The improvement as in claim 8, wherein said wall formed with perforations therethrough is formed in such manner that said perforations are of sufficient opening to admit dust and deny fiber passage therethrough.

13. Apparatus for forming randomized webs from staple fibers, including carding means for disentangling the constituent fibers of fibrous flock and aligning the constituent fibers so that they are oriented substantially axially parallel one another, and randomizing web forming means including a toothed cylinder for bearing thereabout carded fibers, and fiber receiving means for receiving fibers from said toothed cylinder, and mounted intermediate thereto a web former, said web former including an enclosed housing forming a plenum, one wall of said housing positioned adjacent to a portion of said cylinder, of complementary arcuity thereto and spaced therefrom to form a slot passageway of narrowing width from entry upstream of the direction of cylinder rotation to exit downstream thereof measured from the toothed surface to the opposing surface of said housing wall, and another wall of said housing positioned adjacent said fiber receiving means, said one wall being formed with perforations therethrough, and pressure control means for controlling the pressure in the respective passageways between the respective walls and opposing surfaces of said cylinder and said fiber receiving means to a desired value.

14. Apparatus as in claim 13, wherein said fiber receiving means is a doffer cylinder bearing a toothed surface thereabout, said another wall of said housing is of complementary arcuity to said doffer cylinder, and when taken together in aspect with said one wall of said housing forms a wedge-shaped configuration taken in side elevation and in section.

15. Apparatus as in claim 13, wherein said pressure control means includes a pressure sensing element positioned within said plenum of said housing.

16. Apparatus as in claim 15, wherein said housing with plenum is divided into a plurality of chambers having as one wall of each a portion of said one wall of said housing formed with perforations therethrough, and including therewithin a plurality of pressure sensing elements.

17. Apparatus as in claim 16 wherein said plurality of pressure sensing elements is at least a like plurality to said plurality of chambers.

18. Apparatus as in claim 15, wherein said pressure control means includes pressure adjusting means and controller means operatively interconnected therewith, said pressure adjusting means being in intercommunication with said plenum and said controller means being operatively interconnected with said pressure sensing element, wherein said pressure adjusting means includes means for increasing the pressure within said passageways and means for decreasing the pressure within said passageways upon demand and signal from said controller means, for providing an equalization of pressure therein which approaches a predetermined value.

19. Apparatus as in claim 13, wherein said pressure control means includes means for restricting the opening orifice of said slot passageway.

20. Apparatus as in claim 19, wherein said restricting means is in the form of a moveable plate adjustably mounted proximal said entry to said passageway.

* * * * *